US008291621B2

(12) United States Patent
Baucom et al.

(10) Patent No.: US 8,291,621 B2
(45) Date of Patent: Oct. 23, 2012

(54) ARTICLE OF FOOTWEAR WITH A CLEAT MEMBER

(75) Inventors: Jim Baucom, Portland, OR (US); Clifford B. Gerber, West Linn, OR (US); E. Scott Morris, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 971 days.

(21) Appl. No.: 12/061,955

(22) Filed: Apr. 3, 2008

(65) Prior Publication Data

US 2009/0249654 A1 Oct. 8, 2009

(51) Int. Cl.
*A43B 23/00* (2006.01)
*A43B 5/00* (2006.01)

(52) U.S. Cl. ..... 36/134; 36/67 D

(58) Field of Classification Search ..... 36/134, 36/128, 129, 59 R, 62, 65, 67 A, 67 D, 59 A, 36/59 C See application file for complete search history.

(56) References Cited

U.S. PATENT DOCUMENTS

| | | | | |
|---|---|---|---|---|
| 2,532,485 | A | 12/1950 | Dowling | |
| 3,243,831 | A | 4/1966 | Wigley | |
| 4,090,298 | A | 5/1978 | Rushforth | |
| 4,445,288 | A * | 5/1984 | Fror | 36/134 |
| 4,492,047 | A * | 1/1985 | Arff | 36/134 |
| 4,587,748 | A * | 5/1986 | Collins | 36/127 |
| 4,667,422 | A | 5/1987 | Yamaguchi | |
| 4,723,366 | A * | 2/1988 | Hagger | 36/134 |
| 4,791,692 | A | 12/1988 | Collins | |
| 5,027,532 | A * | 7/1991 | MacNeill et al. | 36/134 |
| 5,386,651 | A * | 2/1995 | Okamoto | 36/134 |
| 5,473,827 | A * | 12/1995 | Barre et al. | 36/134 |
| D373,167 | S | 8/1996 | Santos | |
| 5,638,615 | A * | 6/1997 | Korsen | 36/134 |
| 5,675,916 | A * | 10/1997 | Lewis | 36/36 R |
| 5,775,005 | A | 7/1998 | McClelland | |
| 5,782,708 | A | 7/1998 | Kimball, Jr. | |
| 5,960,568 | A * | 10/1999 | Bell et al. | 36/134 |
| 5,996,260 | A | 12/1999 | MacNeill | |
| D433,562 | S | 11/2000 | Redlinger | |
| D474,826 | S | 5/2003 | Goserud | |
| 6,748,677 | B2 * | 6/2004 | Briant et al. | 36/134 |
| 6,957,503 | B2 * | 10/2005 | De Paoli | 36/67 D |
| 7,165,344 | B2 | 1/2007 | Blackwell | |
| 2001/0011429 | A1 | 8/2001 | Peabody | |
| 2002/0078598 | A1 | 6/2002 | Bell | |
| 2005/0257403 | A1 | 11/2005 | De Paoli | |
| 2007/0062070 | A1 | 3/2007 | Kuhtz et al. | |

FOREIGN PATENT DOCUMENTS

| | | |
|---|---|---|
| JP | 06-154008 | 6/1994 |

* cited by examiner

*Primary Examiner* — Jila M Mohandesi
(74) *Attorney, Agent, or Firm* — Plumsea Law Group, LLC

(57) ABSTRACT

A cleat member with a ground engaging portion including a first portion and a second portion is disclosed. The first portion and second portion may be comprised of materials with different traction properties. Additionally, the first portion includes a plurality of grasping portions. Furthermore, the cleat member may be carried on an article other than an article of footwear in a cleat carrying system.

20 Claims, 8 Drawing Sheets

ARTICLE OF FOOTWEAR WITH A CLEAT MEMBER

BACKGROUND OF THE INVENTION

1. Field of the Invention

The present invention relates to an article of footwear, and in particular to an article of footwear with a cleat member.

2. Description of Related Art

MacNeill (U.S. Pat. No. 5,996,260) is directed to a dual density plastic cleat for footwear. MacNeill teaches a removably attachable cleat for shoes. The cleat has a base of strong material and an outer layer of a soft material that absorbs some of the impact force when the cleat strikes a surface. The cleat has four projections. An outer layer of soft deformable material overlays the projections and is supported by a stronger and stiffer material of the base. The outer layer also provides improved traction or slip resistance in environments other than turf penetrating athletic surfaces.

MacNeill also teaches that the outer layer may be semi-transparent or translucent. MacNeill teaches that this allows a user to directly observe the amount of the outer layer remaining over the projections, so that the worn cleat may be replaced before the stiff inner material of the base emerges through the projections.

Khutz (U.S. patent application publication number 2007/0062070) is directed to a traction member for a shoe. Khutz teaches a cleat that includes circumferentially spaced large traction elements extending generally downward and radially outward from a periphery and from a hub. The cleat further includes three small traction elements that are also spaced about the periphery. Khutz also teaches a first component, a second component and third component. Khutz teaches that the first component can be made of opaque polyurethane, the second component can be made of opaque polyurethane and the third component can be made of transparent polyurethane.

SUMMARY OF THE INVENTION

An article of footwear with a cleat member is disposed. In one aspect, the invention provides a cleat member configured to be attached to an article of footwear, comprising: a fastening portion disposed on a proximal portion of the cleat member, the fastening portion being configured to engage the article of footwear; a ground engaging portion disposed on a distal portion of the cleat member, the ground engaging portion being configured to provide traction for the article of footwear; the ground engaging portion comprising a first portion and a second portion; the first portion being made of a first material and the second portion being made of a second material that is different than the first material; and wherein the first portion and the second portion form an outer sidewall portion of the distal portion of the cleat member.

In another aspect, the first portion includes at least one grasping portion extending throughout the ground engaging portion.

In another aspect, the at least one grasping portion has a pointed end portion.

In another aspect, the first material is substantially opaque.

In another aspect, the second material is substantially transparent.

In another aspect, the first material is more rigid than the second material.

In another aspect, the invention provides a cleat member configured to be attached to an article of footwear, comprising: a fastening portion disposed at a proximal portion of the cleat member, the fastening portion being configured to engage the article of footwear; a ground engaging portion disposed on a distal portion of the cleat member, the ground engaging portion being configured to provide traction for the article of footwear; the ground engaging portion including a first portion made of a first material; the first portion including a plurality of grasping portions arranged on an outer periphery of the distal portion; the plurality of grasping portions defining a central cavity portion; and wherein a second portion of the ground engaging member is disposed within a majority of the central cavity portion and wherein the second portion is made of a second material that is different from the first material.

In another aspect, the ground engaging portion has a truncated conical shape.

In another aspect, the ground engaging portion has a substantially flat lower contacting surface.

In another aspect, the first portion and the second portion form an outer sidewall periphery of the ground engaging portion.

In another aspect, the grasping portions have a substantially triangular shape.

In another aspect, the fastening portion is a threaded bolt.

In another aspect, the ground engaging portion includes a recessed portion.

In another aspect, the invention provides a kit of parts comprising: a set of cleat members configured to be attached to an article of footwear; the cleat members each including: a fastening portion disposed on a proximal portion of the cleat member, the fastening portion being configured to engage the article of footwear; a ground engaging portion disposed on a distal portion of the cleat member; the ground engaging portion comprising a first portion and a second portion; the first portion being made of a first material and the second portion being made of a second material that is different than the first material; wherein an outer sidewall portion of the cleat members are formed by the first portion and the second portion; and wherein the set of cleat members includes a number of cleat members corresponding to a required number of cleat members for the article of footwear.

In another aspect, the set of cleat members includes additional spare cleat members beyond the required number of cleat members.

In another aspect, the invention provides a cleat carrying system configured to retain a single cleat member.

In another aspect, the cleat carrying system includes a fastener receiving portion configured to receive a fastening portion of a single cleat member.

In another aspect, the cleat carrying system includes an attachment portion configured to engage a key ring.

In another aspect, the cleat carrying system includes an attachment portion configured to engage a necklace.

In another aspect, the set of cleat members includes additional spare cleat members beyond the required number of cleat members; and further comprising: a cleat carrying system configured to retain a single cleat member, the cleat carrying system including a fastener receiving portion configured to receive a fastening portion of a single cleat member, and an attachment portion; a key ring configured to engage the attachment portion; a necklace configured to engage the attachment portion; and a key fob configured to engage the key ring.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
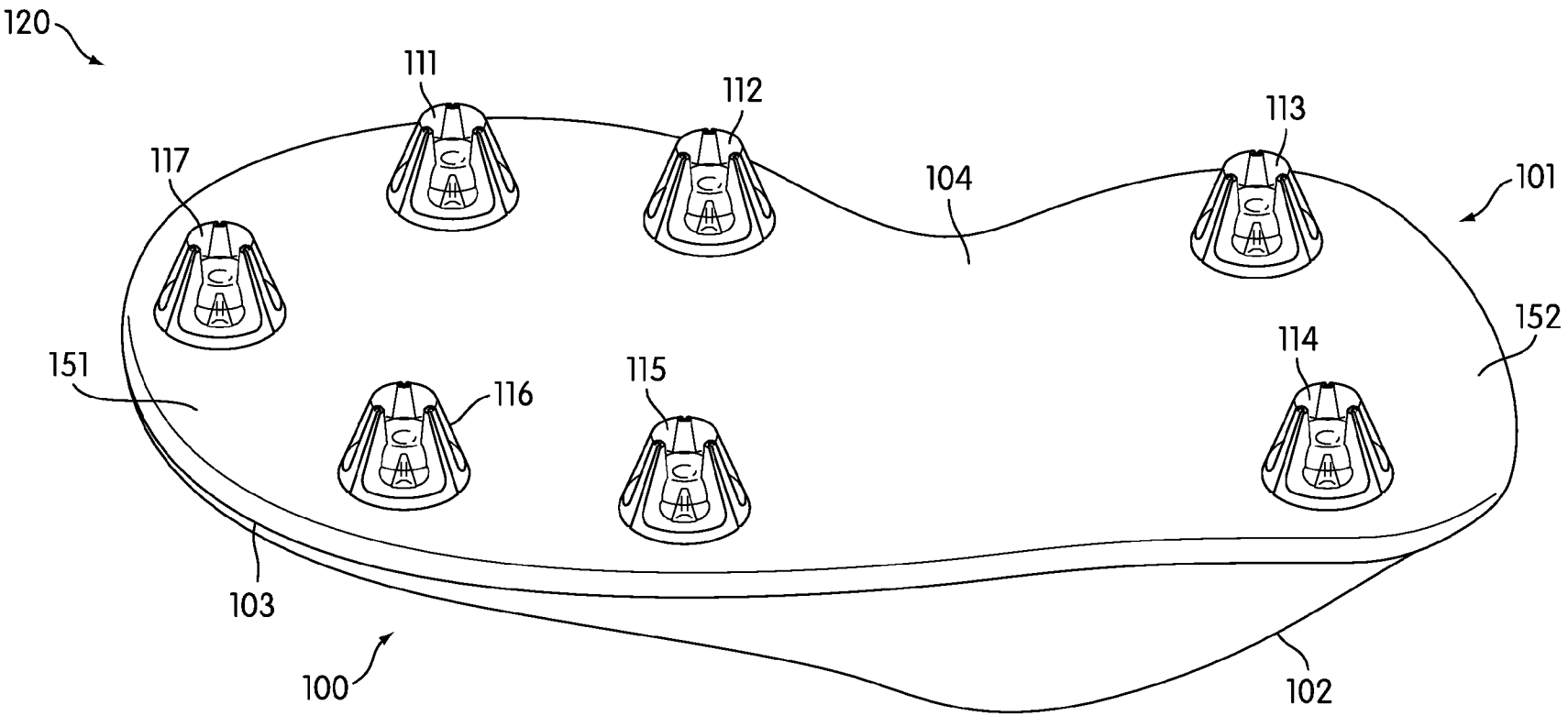
FIG. 1 is a preferred embodiment of an article of footwear configured with cleat members.

FIG. 1 illustrates a preferred embodiment of article of footwear 100. For clarity, the following detailed description discusses a preferred embodiment, in the form of a football shoe, but it should be noted that the present invention could take the form of any article of footwear including, but not limited to, soccer shoes, rugby shoes, baseball shoes as well as other kinds of shoes. As shown in FIG. 1, article of footwear 100, also referred to as simply article 100, is intended to be used with a right foot, however it should be understood that the following discussion may equally apply to a mirror image of article of footwear 100 that is intended for use with a left foot.

Article of footwear 100 preferably includes upper 102. For clarity, only a portion of upper 102 is shown in FIG. 1. Upper 102 may be configured to receive a wearer's foot. Generally, upper 102 may be any type of upper. In particular, upper 102 could have any design, shape, size and/or color. For purposes of illustration, upper 102 is shown generically in this embodiment.

In the current embodiment, article of footwear 100 may also include sole 101. Preferably, sole 101 includes top surface 103 and bottom surface 104. Top surface 103 may be associated with a foot and is configured to contact upper 102, a midsole or an insole of article 100. Bottom surface 104 is preferably configured to contact a ground surface, including, but not limited to natural grass or synthetic grass.

Generally, each component of article of footwear 100 may be constructed of any material. Sole 101 may be constructed from any suitable material, including but not limited to elastomers, siloxanes, natural rubber, other synthetic rubbers, aluminum, steel, natural leather, synthetic leather, or plastics. Also, upper 102 may be made from any suitable material, including but not limited to, for example, nylon, natural leather, synthetic leather, natural rubber, or synthetic rubber.

Preferably, sole 101 includes provisions for increasing traction with a ground surface such as natural grass, synthetic grass or other surfaces. In some cases, sole 101 may include cleat members to enhance traction with the ground. Generally, the term "cleat members" as used in this detailed description and throughout the claims includes any provisions disposed on a sole for increasing traction through friction or penetration of a ground surface. Typically, cleat members may be configured for football, soccer, baseball or any type of activity that requires traction. In this embodiment, sole 101 may be associated with first cleat member 111, second cleat member 112, third cleat member 113, fourth cleat member 114, fifth cleat member 115, sixth cleat member 116 and seventh cleat member 117, referred to collectively as cleat member set 120.

Generally, cleat member set 120 may be associated with sole 101 in any manner. In some embodiments, cleat member set 120 may be screwed into holes within sole 101. In other embodiments, other provisions may be provided to attach cleat member set 120 to sole 101. In still other embodiments, cleat member set 120 may be integrally formed with sole 101. In a preferred embodiment, cleat member set 120 may be screwed into fastener receiving portions in bottom surface 104 of sole 101.

Figure 2:
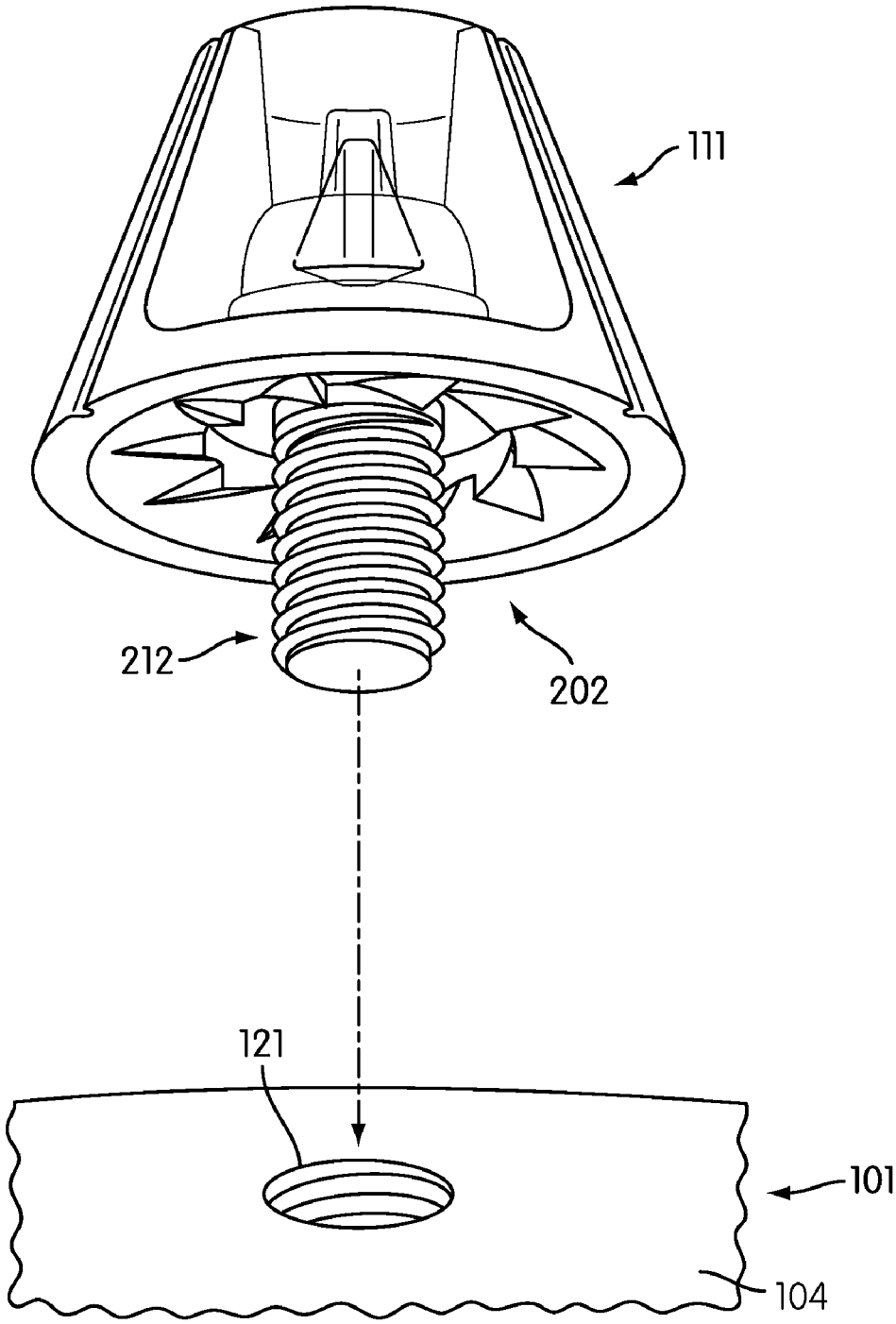
FIG. 2 is an enlarged view of a preferred embodiment of a cleat member configured to releasably attach to a sole of an article of footwear.

FIG. 2 illustrates an enlarged view of a preferred embodiment of first cleat member 111. In this embodiment, first cleat member 111 is configured to attach to fastener receiving portion 121 disposed in bottom surface 104 of sole 101. While FIG. 2 illustrates the attachment of first cleat member 111 to fastener receiving portion 121, it should be understood that the remaining members of cleat member set 120 may be attached in a substantially similar manner to additional fastener receiving portions disposed on bottom surface 104 of sole 101.

In this embodiment, first cleat member 111 includes proximal portion 202. Preferably, proximal portion 202 includes fastening portion 212. Fastening portion 212 may protrude outward from proximal portion 202. With this arrangement, fastening portion 212 may be configured to releasably attach first cleat member 111 to fastener receiving portion 121.

Figure 4:
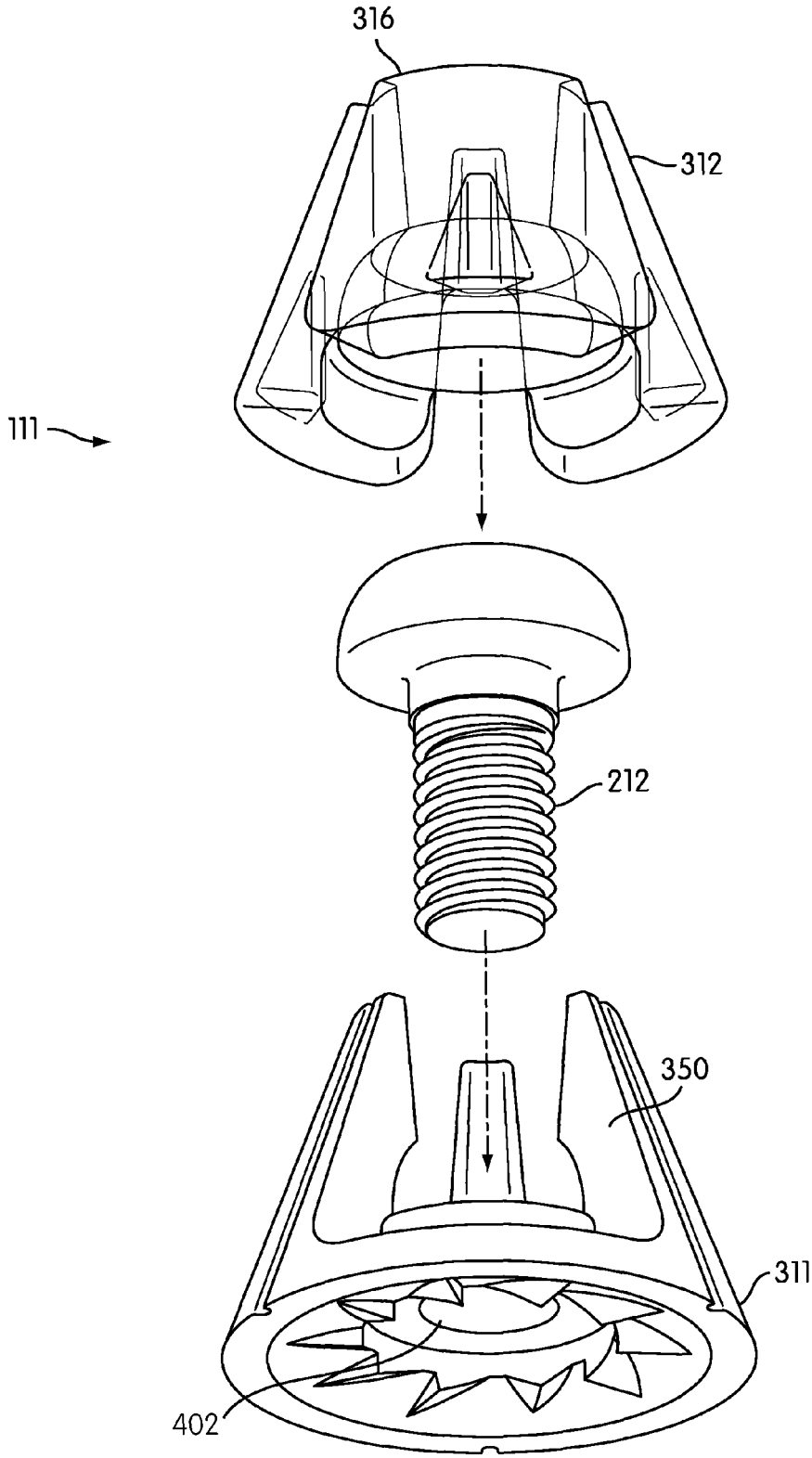
FIG. 4 is an exploded isometric view of a preferred embodiment of a cleat member.

Generally, fastening portion 212 may be configured in any manner to engage fastener receiving portion 121. In particular, fastening portion 212 may be configured with a diameter sufficient to engage and fit within fastener receiving portion 121. In some embodiments, fastening portion 212 may include some type of threading to engage fastener receiving portion 121. Additionally, fastener receiving portion 121 may include grooves configured to receive the threading on fastening portion 212. In a preferred embodiment, fastening portion 212 may be a threaded bolt, as seen in FIG. 4. With this arrangement, fastening portion 212 may be screwed into fastener receiving portion 121.

In some embodiments, proximal portion 202 may be configured with a particular shape to securely fit against sole 101 when fastening portion 212 is inserted and secured within fastener receiving portion 121. For example, if fastener receiving portion 121 protrudes from sole 101, proximal portion 202 may be configured with a concave shape to fit sole 101. In other embodiments where fastener receiving portion 121 is recessed within sole 101, proximal portion 202 may be configured with a convex shape to fit sole 101. In the current embodiment, fastener receiving portion 121 may be generally flush with bottom surface 104 of sole 101. To fit securely against bottom surface 104, proximal portion 202 is configured in a substantially flat manner. With this arrangement, fastening portion 212 may be screwed into fastener receiving portion 121 and proximal portion 202 may be disposed against bottom surface 104 of sole 101.

Generally, a sole may have any number of fastener receiving portions to receive any number of cleat members. Referring to FIG. 1, cleat member set 120 includes seven cleat members. Preferably, each of the cleat members comprising cleat member set 120 is further associated with a fastener receiving portion on sole 101. In particular, in this embodiment, sole 101 may include seven fastener receiving portions. In other embodiments, however, sole 101 may include more or less than seven fastener receiving portions.

Generally, fastener receiving portions on a sole may be arranged in any particular design or pattern on any portion of a sole. Particular configurations of fastener receiving portions and associated cleat members may be associated with different sports or different player positions within a sport. In the embodiment illustrated in FIG. 1, first cleat member 111, second cleat member 112, fifth cleat member 115, sixth cleat member 116 and seventh cleat member 117 are releasably attached to fastener receiving portions disposed on forefoot portion 151 of sole 101. Also, third cleat member 113 and fourth cleat member 114 are secured within fastener receiving portions disposed on heel portion 152. However, in other embodiments, fastener receiving portions may be disposed in alternative patterns. For example, in an alternative embodiment, fastener receiving portions may be disposed on a central region of sole 101. With this alternative arrangement, cleat members may be provided on the central region of sole 101 to allow for increased traction at the central region.

FIGS. 3-6 illustrate enlarged views of a preferred embodiment of first cleat member 111. In some cases, the remaining cleat members of cleat member set 120 may be configured in a substantially similar manner. In other cases, other cleat members of cleat member set 120 may be configured in a different manner.

Figure 3:
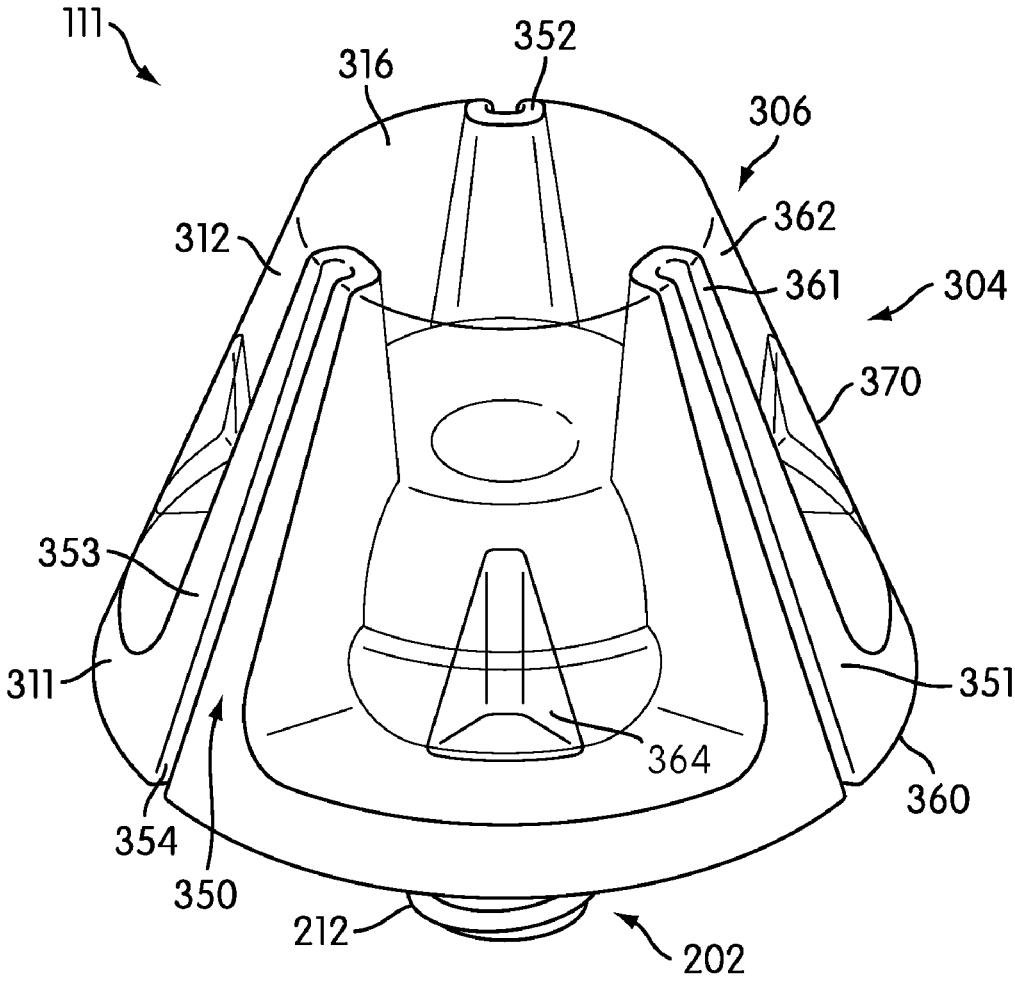
FIG. 3 is an isometric view of a preferred embodiment of a cleat member.

Referring to FIG. 3, first cleat member 111 includes proximal portion 202 and distal portion 304. As previously discussed, proximal portion 202 is configured to engage an article of footwear. In particular, proximal portion 202 includes fastening portion 212 to releasably attach first cleat member 111 to a sole. Distal portion 304 is disposed opposite of proximal portion 202. In order to provide traction for an article of footwear, ground engaging portion 306 is disposed on distal portion 304. Preferably, ground engaging portion 306 is configured to contact a ground surface and provide traction for an article of footwear.

In order to provide traction for an article of footwear, a ground engaging portion of a cleat member may be configured in a particular shape. In some embodiments, a ground engaging portion may have a cylindrical shape with a generally flat lower contacting surface. In other embodiments, a ground engaging portion may have a conical shape with a honed lower contacting surface. In a preferred embodiment, a ground engaging portion may have a truncated conical shape to provide traction for an article of footwear.

Generally, the truncated conical shape of ground engaging portion 306 may provide traction and control for article of footwear 100 during a range of movement. For example, the generally truncated conical shape of ground engaging portion 306 may help facilitate penetration of first cleat member 111 into the ground surface. In some embodiments, ground engaging portion 306 may include substantially flat lower contacting surface 316. Generally, the term "lower contacting surface" as used in this detailed description and throughout the claims includes a portion of a cleat member that contacts a ground surface initially and/or when no ground penetration occurs. Substantially flat lower contacting surface 316 preferably provides ground engaging portion 306 with a stable resting position on the ground surface.

In order to enhance traction for a wearer during typical movements such as cutting or turning, acceleration and deceleration, as well as stopping, ground engaging portion 306 may include multiple distinct portions. In some embodiments, ground engaging portion 306 could be associated with two distinct portions. In this preferred embodiment, ground engaging portion 306 may include first portion 311 and second portion 312. In still other embodiments, ground engaging portion 306 could include additional distinct portions as well.

In some embodiments, first portion 311 of ground engaging portion 306 may be disposed adjacent to fastening portion 212. In particular, first portion 311 may be configured to contact a sole of an article of footwear at proximal portion 202 of first cleat member 111. Likewise, second portion 312 may be disposed adjacent to first portion 311. In this preferred embodiment, second portion 312 includes lower contacting surface 316. With this arrangement, second portion 312 may initially contact a ground surface to provide traction.

In some cases, a ground engaging portion of a cleat member may include grasping portions to enhance the traction abilities of a cleat member. In this embodiment, first portion 311 of ground engaging portion 306 includes a plurality of grasping portions 350. In particular, grasping portions 350 include first grasping portion 351, second grasping portion 352 and third grasping portion 353. In this manner, grasping portions 350 extend throughout ground engaging portion 306.

Generally, grasping portions 350 may include any number of grasping portions. In some embodiments, grasping portions 350 may include four or more grasping portions. In other embodiments, grasping portions 350 may include two grasping portions. In still other embodiments, grasping portions 350 may include a single grasping portion. In this preferred embodiment, grasping portions 350 include three grasping portions.

In some embodiments, the lengths of grasping portions 350 can vary. In one embodiment, seen in FIG. 3, grasping portions 350 can extend over the entire length of ground engaging portion 306. In particular, grasping portions 350 could extend to lower contacting surface 316. In another embodiment, seen in FIGS. 10-12, grasping portions may not extend over the entire length of a ground engaging portion. Instead, the tip of the grasping portions could be disposed away from a lower contacting surface of the cleat. By varying the length of the grasping portions, the performance or response characteristics may be varied. It is also possible to modify the traction properties of ground engaging portion 306 by modifying the relative length of grasping portions 350 with respect to ground engaging portion 306.

In some embodiments, ground engaging portion 306 may be configured with additional-provisions for engaging a tool that may attach cleat member 111 to an article of footwear. In some cases, ground engaging portion 306 may include one or more recessed portions. Generally, the recessed portions could be disposed on first portion 311 or second portion 312. In this preferred embodiment, first recessed portions 364 may be disposed on second portion 312. In particular, first recessed portions 364 may have a generally triangular shape. With this arrangement, first recessed portions 364 may engage a tool to secure cleat member 111 to an article.

Figure 10:
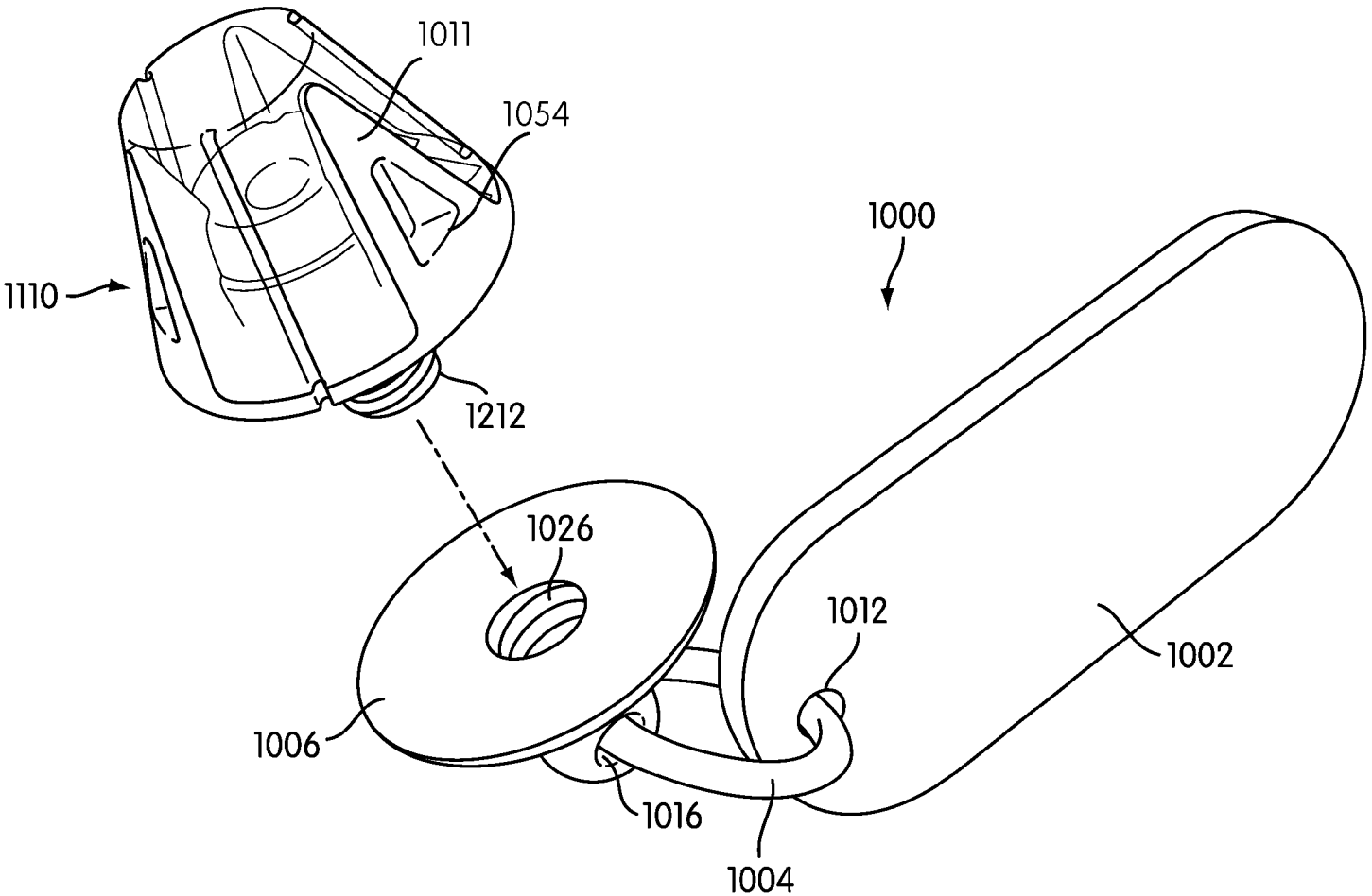
FIG. 10 is an unassembled view of an exemplary embodiment of a cleat carrying system with a key ring.

Although the current embodiment includes first recessed portions 364 disposed on second portion 312, in an alternative embodiment, seen in FIG. 10, second recessed portions 1054 may be disposed on first portion 1011 of cleat member 1110.

Generally recessed portions may have any size and shape. Examples of various shapes include, but are not limited to, squares, rectangles, circles, ovals, polygonal and irregular shapes, as well as any other type of shape. Additionally, the depth of recessed portions can vary. By using different shapes recessed with different depths, recessed portions may be configured to engage a tool to attach a cleat member to an article of footwear.

Grasping portions 350 include recessed regions 354. In some cases, recessed regions 354 may be a product of the manufacture of grasping portions 350. In other cases, recessed regions 354 can provide additional traction capabilities to grasping portions 350. In this manner, grasping portions 350 preferably increase the traction capabilities of first cleat member 111.

FIG. 4 is an exploded isometric view of a preferred embodiment of first cleat member 111 configured to illustrate the general assembly of first portion 311 and second portion 312. In some embodiments, fastening portion 212 may be inserted between grasping portions 350 and through fastener hole 402 of first portion 311. Following the attachment of fastening portion 212 to first portion 311, second portion 312 may be attached to first portion 311 to form first cleat member 111. It should be understood that this method of constructing a cleat member is only intended to be exemplary and in other embodiments other methods may be used.

Referring back to FIG. 3, second portion 312 may be configured to fill in and around grasping portions 350. In this manner, potentially honed edges or pointed end portions of grasping portions 350 may be shielded from ground contact as well as contact with other objects or people. In addition, with this arrangement, second portion 312 may increase the strength and stability of grasping portions 350 by surrounding grasping portions 350.

Preferably, ground engaging portion 306 is configured so that both first portion 311 and second portion 312 are both exposed on an outer portion of first cleat member 111. In this embodiment, first portion 311 and second portion 312 may comprise outer sidewall portion 370 of distal portion 304. In particular, grasping portions 350 include first outer surface 361. In a similar manner, second portion 312 includes second outer surface 362. In some cases, first outer surface 361 and second outer surface 362 may be coincident, or flush, with each other. With this arrangement, outer sidewall portion 370 may be configured to improve traction for an article of footwear by providing contact between a ground surface and both first portion 311 and second portion 312.

Figure 5:
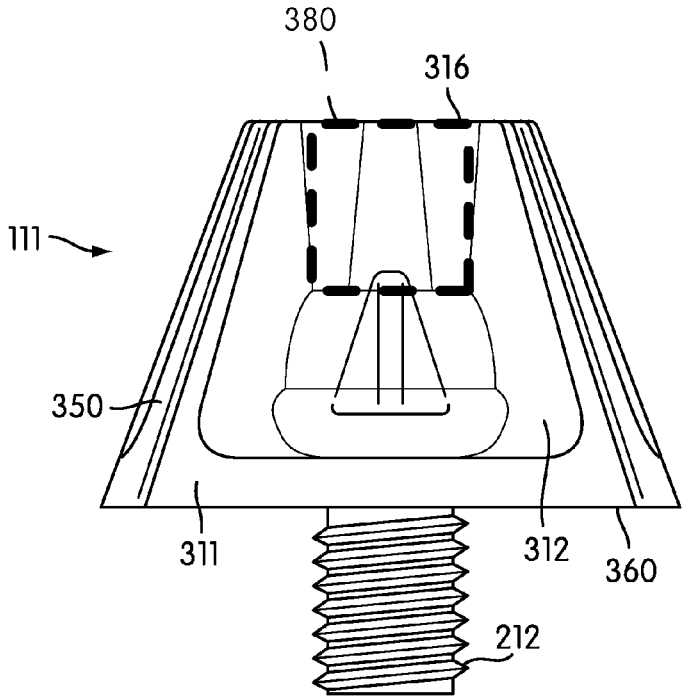
FIG. 5 is a side view of a preferred embodiment of a cleat member.
Figure 6:
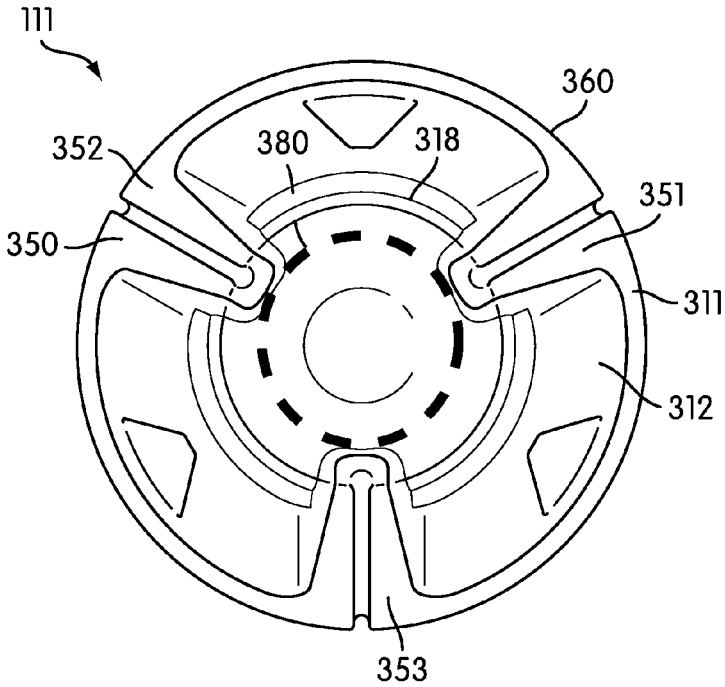
FIG. 6 is a top down view of a preferred embodiment of a cleat member.

Referring to FIGS. 5 and 6, first portion 311 of first cleat member 111 may be configured to grasp second portion 312 of first cleat member 111. In some cases, this arrangement may help increase the durability of first cleat member 111. As seen in FIG. 6, grasping portions 350 may be disposed on outer periphery 360 of first portion 311. Furthermore, grasping portions 350 may preferably be arranged to define central cavity portion 380. In particular, inner periphery 318 of grasping portions 350 may define an outer boundary for central cavity portion 380. In the current embodiment, central cavity portion 380 is configured with a generally cylindrical volume. In other embodiments, however, central cavity portion 380 could have any shape, including, but not limited to a rectangular prism shape, a regular prism shape, an irregular prism shape, a spherical shape as well as any other shape.

In some embodiments, second portion 312 of ground engaging portion 306 may be disposed within a majority of central cavity portion 380. In other words, central cavity portion 380 is preferably filled in by second portion 312. With this configuration, grasping portions 350 of first portion 311 may help hold second portion 312 within central cavity portion 380.

A cleat member may be made of one or more materials. In some embodiments, a first portion of the cleat member may be made of a similar material to a second portion of the cleat member. Preferably, the first portion and the second portion of the cleat member may be made of different materials that provide different material properties including different types of rigidity, different types of friction, different refractive properties as well as other material properties. By using different materials for the first portion and the second portion, the overall material properties of the cleat member can be tuned in a variety of ways. For example, in some cases, the traction properties of the cleat member may be tuned or modified by using materials with different traction properties for the first portion and the second portion.

In some embodiments, first portion 311 is made of a first material. In a similar manner, second portion 312 is made of a second material. In a preferred embodiment, the first material may be different from the second material.

In some embodiments, different materials may provide different traction properties. For example, a material with greater stiffness may provide increased ground penetration than a more flexible material. In a similar manner, a more flexible material may deform during contact with a ground surface to provide greater rotational capability. Preferably, materials may be selected for a ground engaging portion to increase the traction capabilities of a cleat member.

In this preferred embodiment, first portion 311 is made of a first material that is more rigid than a second material that comprises second portion 312. In a preferred embodiment, first portion 311 may be made of a rigid plastic material. Additionally, second portion 312 may be made of a flexible plastic material. With this arrangement, first portion 311 and second portion 312 may deform in different manners following contact with a ground surface and provide different traction properties for an article of footwear.

In some cases, different portions of a cleat member may have different refractive properties. In some cases, a first portion of the cleat member may be substantially opaque. Likewise, a second portion of the cleat member may be substantially transparent. This may assist a wearer in determining wear on a cleat member. For example, as the second portion wears down, the first portion may be come more clearly visible through the substantially transparent second portion.

In this embodiment, second portion 312 may be comprised of a second material that is a substantially transparent material. In some cases, the use of a transparent material may allow wear of first cleat member 111 to be more visible. In other words, the transparent material of second portion 312 allows easier inspection of first cleat member 111 for wear. Additionally, first portion 311 may be comprised of a first material that is opaque. With this arrangement, the visibility of first portion 311 may be enhanced by the transparency of second portion 312. This may provide a pleasing aesthetic appearance with first portion 311 visibly prominent on first cleat member 111.

It is also possible that a first material of a first portion may be transparent while a second material of a second portion is opaque. In this alternative embodiment, a second portion may be more visibly prominent due to the transparent material of the first portion. In other embodiments, a first portion and a second portion may both be transparent to diminish the visibility of a cleat member. In this manner, the appearance of a cleat member may be altered.

Figure 7:
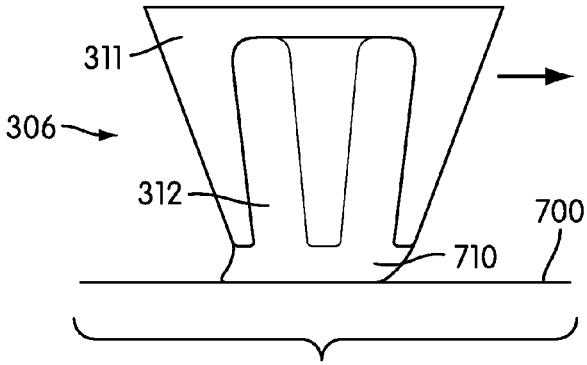
FIG. 7 is a schematic view of an exemplary embodiment of a ground engaging portion of a cleat member experiencing shearing forces following contact with a ground surface.
Figure 8:
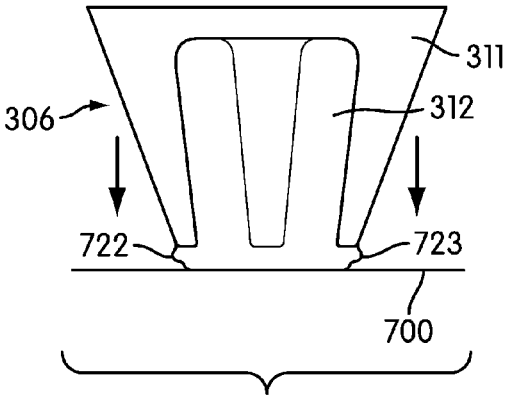
FIG. 8 is a schematic view of an exemplary embodiment of a ground engaging portion of a cleat member experiencing compression forces following contact with a ground surface.
Figure 9:
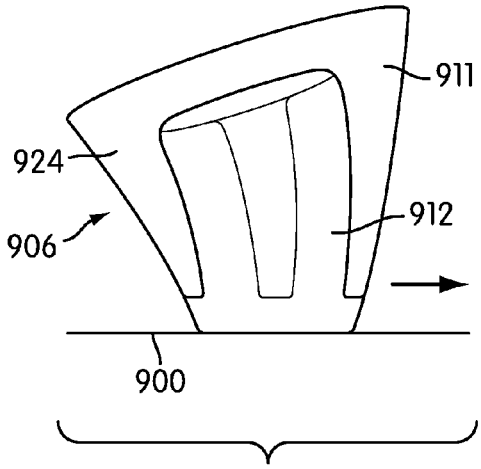
FIG. 9 is a schematic view of an exemplary embodiment of a ground engaging portion of a cleat member experiencing shearing forces following contact with a ground surface.

FIGS. 7-9 are schematic views of exemplary embodiments of a ground engaging portion of a cleat member encountering a ground surface. Generally, a ground surface may be any type of ground surface including, but not limited to natural grass or synthetic grass. The scenarios illustrated in these embodiments are intended to be exemplary. Furthermore, the deformation of the ground engaging portion in these embodiments may be exaggerated for illustrative purposes. In some embodiments, a ground engaging portion may experience more or less deformation. In other embodiments, a ground engaging portion may experience other effects following contact with a ground surface.

Generally, the materials comprising a ground engaging portion may impact the deformation of the ground engaging portion following contact with a ground surface. By using different materials for one or more portions of a cleat, the type and degree of deformation may vary. With this arrangement, it may be possible to fine tune the deformation characteristics of the cleat using different combinations of materials.

Referring to FIG. 7, ground engaging portion 306 experiences shearing forces following contact with ground surface 700. Generally, the term "shearing forces" as used in this detailed description and throughout the claims includes forces substantially parallel to a ground surface. Typically, shearing forces may result from a variety of movements that may be executed by a potential wearer of an article of footwear. In some cases, shearing forces may be created by a wearer cutting or turning while moving on ground surface 700. In other cases, shearing forces may result from a wearer accelerating or decelerating on ground surface 700.

In this exemplary embodiment, shearing forces applied to ground engaging portion 306 cause second portion 312 to deform. Specifically, first deformation region 710 of second portion 312 deforms in response to shearing forces. As previously discussed, second portion 312 is made of a second material that is less rigid than a first material comprising first portion 311. As a result of the differences in rigidity of the first and second materials, second portion 312 deforms while first portion 311 does not deform.

The deformation of second portion 312 and rigidity of first portion 311 preferably provide traction and stability for a wearer. In some cases, deformation of second portion 312 may provide greater stability for lateral movements as well as forward and rearward movement. With this configuration, ground engaging portion 306 preferably increases the traction and stability for a wearer experiencing shearing forces.

Referring to FIG. 8, ground engaging portion 306 experiences compression forces following contact with ground surface 700. Generally, compression forces may be encountered during typical movements including, but not limited to, stopping, accelerating and decelerating. In some cases, compression forces may cause ground engaging portion 306 to penetrate ground surface 700. In this exemplary embodiment, compression forces do not cause ground engaging portion 306 to penetrate ground surface 700.

Compression forces in this exemplary embodiment cause second portion 312 to deform. Because second portion 312 is made of a generally flexible material, second portion 312 deforms and bulges at second deformation region 722 and third deformation region 723. In contrast, first portion 311 does not deform since first portion 311 is made of a first material that is more rigid than the second material of second portion 312.

In some cases, the deformation at second deformation region 722 and third deformation region 723 may absorb and dampen the effect of the compression forces. Furthermore, the rigidity of first portion 311 may provide increased stability for lateral as well as forward and rearward movement. This combination of deformation and rigidity preferably provides ground engaging portion 306 with traction and stability while undergoing compression forces.

As previously discussed, the relative rigidities of a first portion and a second portion of a ground engaging portion may be varied. For example, in some embodiments, a second portion may be constructed from a second material that is more rigid than a first material comprising a first portion. Altering the relative rigidities of a first portion and a second portion of a ground engaging portion may provide different traction properties to a cleat member.

FIG. 9 illustrates an exemplary embodiment of ground engaging portion 906 contacting ground surface 900. In this embodiment, ground engaging portion 906 is substantially similar to ground engaging portion 306 in the previous embodiment. In particular, ground engaging portion 906 includes first portion 911 and second portion 912. Furthermore, first portion 911 is made of a first material and second portion 912 is made of a second material. In this alternative embodiment, the second material of second portion 912 is preferably more rigid than the first material of first portion 911.

In this embodiment, ground engaging portion 906 experiences shearing forces. Due to the shearing forces, first portion 911 deforms at fourth deformation region 924. However, the greater rigidity of the second material comprising second portion 912 causes second portion 912 to resist deforming. With the relatively less rigid first material, first portion 911 deforms when experiencing shearing forces while second portion 912 remains substantially stiff.

By deforming at first portion 911, ground engaging portion 906 provides particular traction features. In some cases, the deformation of first portion 911 and the rigidity of second portion 912 may increase the rotational capabilities of ground engaging portion 906. In other words, the rigidity of second portion 912 may enhance the ability to turn by remaining rigid and not engaging ground surface 900. Preferably, this combination of rigidity and deformation within ground engaging portion 906 allows greater traction and control when contacting ground surface 900.

Preferably, cleat members may be easily accessible when not attached to an article of footwear. In some embodiments, a cleat member may be configured to releasably attach to a cleat carrying system. Generally, the term "cleat carrying system" as used in this detailed description and throughout the claims includes an article comprising a fastener receiving portion configured to receive and releasably attach a fastening portion of a cleat member. In some cases, an article may be a key ring. In other cases, an article may be an article of jewelry such as a bracelet or necklace. In still other cases, an article may be an article of storage such as a backpack.

Generally, a cleat carrying system may be useful because it keeps a cleat member easily accessible. In some cases, a cleat carrying system may carry a cleat member so that a user may have a spare cleat for an article of footwear. For example, the user may replace a worn cleat member on an article of footwear using this spare cleat. In other cases, a cleat carrying system may carry a cleat member configured with a set of features in order to replace a cleat member configured with a different set of features on an article of footwear. For example, if ground conditions change, a wearer of a pair of footwear may wish to change to a cleat member with different traction properties. In still other cases, a cleat carrying system may appeal to a user for aesthetic decoration.

Figure 11:
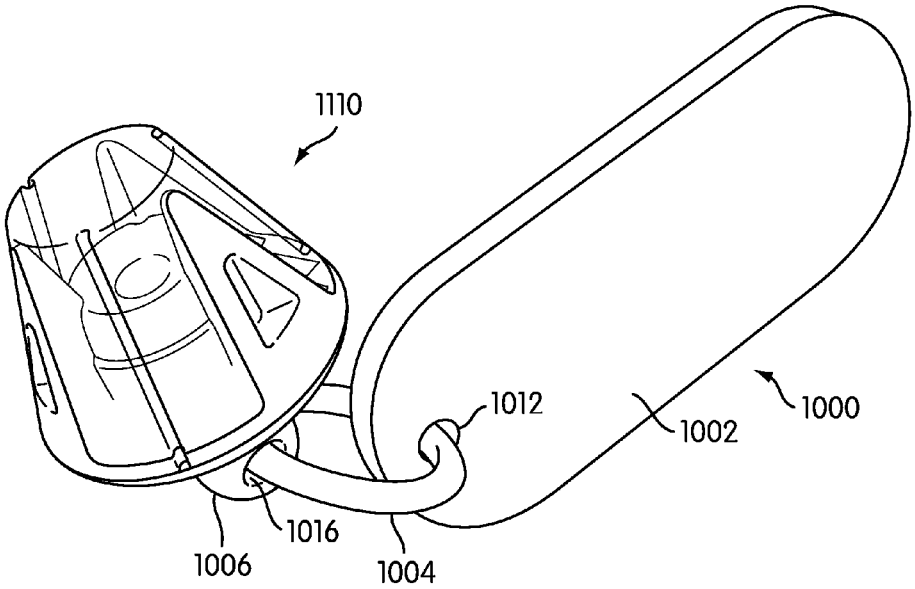
FIG. 11 is an assembled view of an exemplary embodiment of a cleat carrying system with a key ring.

FIGS. 10-11 illustrate an exemplary embodiment of cleat carrying system 1000. In this exemplary embodiment, cleat carrying system 1000 is configured as key ring 1004. Generally, key ring 1004 is intended to attach keys. For purposes of clarity, only some portions of key ring 1004 are shown in the figures. In other embodiments, key ring 1004 may include other portions, including but not limited to keys, key cards, security tokens, and vehicle remote keyless systems.

In this exemplary embodiment, key ring 1004 includes key fob 1002. Generally, key fob 1002 may be any shape or size. In some cases, key fob 1002 may extend a greater distance from key ring 1004. Furthermore, key fob 1002 may attach to key ring 1004 in any manner.

In addition, key ring 1004 includes fastener receiving portion 1006. Generally, fastener receiving portion 1006 may be attached to key ring 1004 in any manner. In this exemplary embodiment, fastener receiving portion 1006 includes attachment portion 1016. By sliding attachment portion 1016 into key ring 1004, fastener receiving portion 1006 may be securely but releasably attached to key ring 1004.

Preferably, fastener receiving portion 1006 is configured to receive a cleat member. Referring to FIG. 10, fastener receiving portion 1006 includes second hole 1026. Second hole 1026 is configured to releasably attach fastening portion 1212 of cleat member 1110 to fastener receiving portion 1006. Cleat member 1110 may be configured with all the features and provisions discussed in previous embodiments. Generally, cleat member 1110 may attach to fastener receiving portion 1006 in a substantially similar manner as first cleat member 111 attached to fastener receiving portion 121 as seen in FIG. 2. In this embodiment, fastening portion 1212 of cleat member 1110 may be screwed into hole 1026 of fastener receiving portion 1006.

FIG. 11 illustrates an assembled view of cleat carrying system 1000. With this arrangement, cleat member 1110 is releasably attached to key ring 1004. This can provide a convenient place to keep cleat member 1110 and/or provide aesthetic decoration for key ring 1004.

Figure 12:
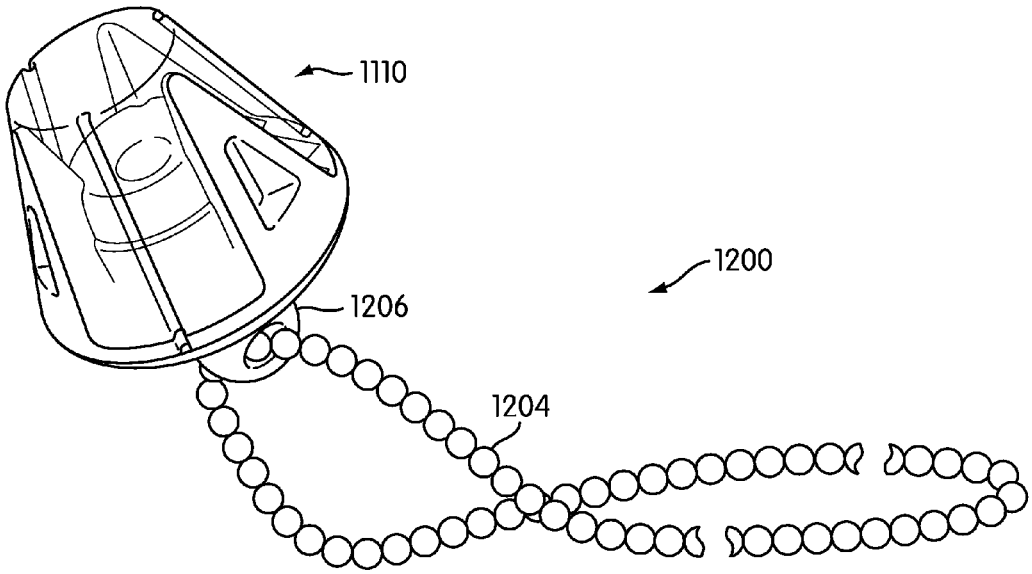
FIG. 12 is schematic view of an exemplary embodiment of a cleat carrying system with a necklace.

As discussed previously, an article of jewelry may be configured as a cleat carrying system. FIG. 12 illustrates an exemplary embodiment of cleat carrying system 1200 configured as necklace 1204. Generally, necklace 1204 may be worn around a neck. It should be understood that necklace 1204 is intended to be exemplary and in other embodiments necklace 1204 may be configured in a different manner.

Preferably, necklace 1204 includes fastener receiving portion 1206. Fastener receiving portion 1206 may be configured in a substantially similar manner as fastener receiving portion 1006 of the previous embodiment. In particular, fastener receiving portion 1206 may be associated with attachment portion 1216 that engages necklace 1204. With this arrangement, cleat member 1110 may be releasably attached to fastener receiving portion 1206 and necklace 1204. In this manner, cleat member 1110 may be carried by cleat carrying system 1200.

Although the exemplary embodiments of cleat carrying systems included one cleat member, it is also possible to attach multiple cleat members to a cleat carrying system. In some embodiments, a cleat carrying system may include multiple fastener receiving portions configured to receive multiple cleat members. In some cases, a cleat carrying system may include a set of fastener receiving portions sufficient to replace a full set of cleat members on an article of footwear. In other cases, a cleat carrying system may include a set of fastener receiving portions sufficient to replace a full set of cleat members on a pair of footwear. With this arrangement, a wearer of a pair of footwear configured with cleat members may keep replacement cleat members easily accessible.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A cleat member configured to be attached to an article of footwear, comprising:

a fastening portion disposed on a proximal portion of the cleat member, the fastening portion being configured to engage a sole of the article of footwear;

a ground engaging portion disposed on a distal portion of the cleat member, the ground engaging portion being configured to provide traction in contact with a ground surface for the article of footwear and configured to extend away from the sole of the article of footwear;

the ground engaging portion comprising a first portion and a second portion;

the first portion being made of a first material and the second portion being made of a second material that is different than the first material;

wherein the first portion and the second portion form an outer sidewall portion of the distal portion of the cleat member, the outer sidewall portion extending throughout the length of the ground engaging portion extending away from the sole of the article of footwear;

wherein the first portion includes a first outer surface and the second portion includes a second outer surface; and wherein the first outer surface and the second outer surface are flush with each other throughout the entirety of the outer sidewall portion.

2. The cleat member according to claim 1, wherein the first portion includes at least one grasping portion extending throughout the ground engaging portion.

3. The cleat member according to claim 2, wherein the at least one grasping portion has a pointed end portion.

4. The cleat member according to claim 1, wherein the first material is substantially opaque.

5. The cleat member according to claim 4, wherein the second material is substantially transparent.

6. The cleat member according to claim 1, wherein the first material is more rigid than the second material.

7. A cleat member configured to be attached to an article of footwear, comprising:

a fastening portion disposed at a proximal portion of the cleat member, the fastening portion being configured to engage a sole of the article of footwear;

a ground engaging portion disposed on a distal portion of the cleat member, the ground engaging portion being configured to provide traction with a ground surface for the article of footwear and configured to extend away from the sole of the article of footwear;

the ground engaging portion including a first portion made of a first material;

the first portion including a plurality of grasping portions arranged on an outer periphery of the distal portion and extending throughout the length of the ground engaging portion extending away from the sole of the article of footwear;

the plurality of grasping portions defining a central cavity portion;

wherein a second portion of the ground engaging member is disposed within a majority of the central cavity portion, the second portion filling the central cavity portion;

wherein the plurality of grasping portions are in contact with an outer periphery of the second portion and wherein the plurality of grasping portions are co-extensive with the second portion along the entirety of the length of the second portion; and wherein the second portion is made of a second material that is different from the first material.

8. The cleat member according to claim 7, wherein the ground engaging portion has a truncated conical shape.

9. The cleat member according to claim 7, wherein the ground engaging portion has a substantially flat lower contacting surface.

10. The cleat member according to claim 7, wherein the first portion and the second portion form an outer sidewall periphery of the ground engaging portion.

11. The cleat member according to claim 7, wherein the grasping portions have a substantially triangular shape.

12. The cleat member according to claim 7, wherein the fastening portion is a threaded bolt.

13. The cleat member according to claim 7, wherein the ground engaging portion includes a recessed portion.

14. A kit of parts comprising:

a set of cleat members configured to be attached to an article of footwear; the cleat members each including:

a fastening portion disposed on a proximal portion of the cleat member, the fastening portion being configured to engage a sole of the article of footwear;

a ground engaging portion disposed on a distal portion of the cleat member, the ground engaging portion being configured to provide traction in contact with a ground surface for the article of footwear and configured to extend away from the sole of the article of footwear;

the ground engaging portion comprising a first portion and a second portion;

the first portion being made of a first material and the second portion being made of a second material that is different than the first material wherein an outer sidewall portion of the cleat members are formed by the first portion and the second portion, the outer sidewall portion extending throughout the length of the ground engaging portion extending away from the sole of the article of footwear;

wherein a first outer surface of the first portion and a second outer surface of the second portion are flush with each other throughout the entirety of the outer sidewall portion; and wherein the set of cleat members includes a number of cleat members corresponding to a required number of cleat members for the article of footwear.

15. The kit of parts according to claim 14, wherein the set of cleat members includes additional spare cleat members beyond the required number of cleat members.

16. The kit of parts according to claim 14, further comprising a cleat carrying system configured to retain a single cleat member.

17. The kit of parts according to claim 16, wherein the cleat carrying system includes a fastener receiving portion configured to receive a fastening portion of a single cleat member.

18. The kit of parts according to claim 16, wherein the cleat carrying system includes an attachment portion configured to engage a key ring.

19. The kit of parts according to claim 16, wherein the cleat carrying system includes an attachment portion configured to engage a necklace.

20. The kit of parts according to claim 14, wherein the set of cleat members includes additional spare cleat members beyond the required number of cleat members; and further comprising:

a cleat carrying system configured to retain a single cleat member, the cleat carrying system including a fastener receiving portion configured to receive a fastening portion of a single cleat member, and an attachment portion;

a key ring configured to engage the attachment portion;

a necklace configured to engage the attachment portion; and a key fob configured to engage the key ring.

* * * * *